US010759647B1

(12) United States Patent
Fabozzi et al.

(10) Patent No.: US 10,759,647 B1
(45) Date of Patent: Sep. 1, 2020

(54) METHOD AND DEVICE FOR DISPENSING FROM AN INVERTED SHIPPABLE CONTAINER

(71) Applicant: Plastic Technologies, Inc., Holland, OH (US)

(72) Inventors: Thierry Fabozzi, Holland, OH (US); Daniel Applegate, Holland, OH (US); Aaron Bollinger, Holland, OH (US); Craig Robinson, Holland, OH (US); Sumit Mukherjee, Holland, OH (US)

(73) Assignee: PLASTIC TECHNOLOGIES, INC., Holland, OH (US)

( * ) Notice: Subject to any disclaimer, the term of this patent is extended or adjusted under 35 U.S.C. 154(b) by 0 days.

(21) Appl. No.: 16/383,970

(22) Filed: Apr. 15, 2019

(51) Int. Cl.

| | |
|---|---|
| ***B67D 3/00*** | (2006.01) |
| ***B67D 1/08*** | (2006.01) |
| ***A47K 5/13*** | (2006.01) |
| ***B67D 1/00*** | (2006.01) |

(52) U.S. Cl.
CPC ..... *B67D 3/0035* (2013.01); *A47K 5/13* (2013.01); *B67D 1/0006* (2013.01); *B67D 1/0801* (2013.01); *B67D 3/0003* (2013.01); *B67D 3/0061* (2013.01); *B67D 2210/00031* (2013.01); *B67D 2210/00097* (2013.01)

(58) Field of Classification Search
CPC .. B67D 3/0035; B67D 1/0801; B67D 3/0061; B67D 1/0006; B67D 3/0003; B67D 2210/00031; B67D 2210/00097; A47K 5/13
See application file for complete search history.

(56) References Cited

U.S. PATENT DOCUMENTS

| | | | | |
|---|---|---|---|---|
| 4,651,902 | A * | 3/1987 | Hobbs | A47K 5/1211 222/153.09 |
| 5,228,601 | A * | 7/1993 | Podesta | A47K 5/13 222/181.2 |
| 2008/0283556 | A1* | 11/2008 | Snodgrass | A47K 5/13 222/325 |
| 2009/0302038 | A1* | 12/2009 | Taggart | B67D 1/0082 220/260 |
| 2010/0065581 | A1* | 3/2010 | Thomason | A47K 5/13 222/105 |
| 2013/0221032 | A1* | 8/2013 | Norris | B05B 1/326 222/185.1 |
| 2017/0008746 | A1* | 1/2017 | Roberts | B67D 3/0029 |
| 2019/0127203 | A1* | 5/2019 | Bhutani | B67D 1/08 |
| 2019/0367351 | A1* | 12/2019 | French | B65D 47/265 |

* cited by examiner

*Primary Examiner* — Donnell A Long
(74) *Attorney, Agent, or Firm* — Michael E. Dockins; Shumaker, Loop Kendrick, LLP

(57) ABSTRACT

A dispenser for a shippable container is provided, where the shippable container has a hollow body, an opening, a collar adjacent the opening, and a closure sealing the opening. The dispenser has a collar engagement portion configured to engage the collar of the shippable container, a closure engagement portion configured to engage the closure of the shippable container, and a body engagement portion configured to engage a portion of the hollow body of the shippable container. An aperture in the dispenser is configured to dispense contents from the hollow body of the shippable container. The dispenser can be configured to dispense contents from the hollow body of the shippable container when the shippable container is in an inverted position.

20 Claims, 5 Drawing Sheets

METHOD AND DEVICE FOR DISPENSING FROM AN INVERTED SHIPPABLE CONTAINER

FIELD

The present technology relates to shippable containers and frames adapted to shippable containers, including frames that facilitate handling shippable containers and dispensing contents therefrom.

INTRODUCTION

This section provides background information related to the present disclosure which is not necessarily prior art.

Various containers, including various bottles and vessels of various shapes and configurations, can be used for storage and packaging of various contents during transport, shipping, and/or eventual dispensing of the contents therefrom. Contents can include various fluids, including liquids, foams, gels, or other compositions that can flow and that can be managed by various filling and dispensing means. Examples include containers used to store, ship, and dispense various products, including various chemicals, soaps, lotions, and cleaning products, as well as medicines, beverages and foodstuffs, such as water, carbonated drinks, sports drinks, condiments, and sauces, among others. Containers can include a neck or finish portion having an opening that is in communication with an interior hollow body of the container. In some instances, the neck or finish portion can be threaded to permit application of a closure. For example, a structure can be molded into the neck or finish portion to permit a closure to be threaded or snapped on. The neck or finish portion can include at least one sealing surface that is configured to bear against a portion of the closure in order to form a fluid tight seal with respect to the closure when it is properly applied. Containers can also be configured with various integral closure means and/or can be configured to receive various closure means, including various adhesive films, heat seals, threaded caps, snap caps, bottle caps, as well as various tamper evident seals and closures.

A variety of materials have been employed in the design and construction of such containers. For example, containers can be made using various materials including polymeric materials. Such materials are used, at least in part, because they can securely contain liquids or other contents while also providing sufficient structural rigidity and integrity in accommodating various filling, bottling, distributing, shipping, and handling operations. Polymeric containers include various polymeric containers made of polyethylene terephthalate (PET), polypropylene (PP), polyethylene (PE), as well as other suitable materials. Plastic containers can be fabricated using various blow molding and injection molding methods. Blow molding can be characterized by using internal pressure to force a heated plastic preform or parison against a molding surface to form a desired container shape, which can be used for plastic containers that are fabricated from PET, for example. Extrusion blow molding is another process that can be used for containers fabricated from such materials as high-density PE and polyolefins. Blow molded containers can be formed with a integral closure means, such as a threaded finish, at an opening of the container that can be configured to cooperate with a threaded closure, dispenser, and/or cap in order to seal the contents inside the container. The threaded finish can originate from the preform or parison, for example.

In the packaging and shipping industry, lightweight containers can be preferred as they can require less material investment, can be relatively less costly to manufacture and transport, and can minimize waste or recycling logistics. Moving to lightweight containers, however, can result in tradeoffs with respect to structural rigidity and integrity of such containers. Accordingly, there is a need to provide ways to minimize container fabrication and shipping costs while maintaining container durability through various uses thereof, including handling and dispensing of the contents of such containers.

SUMMARY

The present technology includes articles of manufacture, systems, and processes that relate to shippable containers, dispensers that accommodate such shippable containers, and ways of using dispensers to hold and dispense various products from shippable containers.

Dispensers for a shippable container are provided, where the shippable container includes a hollow body, an opening, a collar adjacent the opening, and a closure sealing the opening. The dispenser accommodates the shippable container using a collar engagement portion a collar engagement portion configured to engage the collar of the shippable container, a closure engagement portion configured to engage the closure of the shippable container, a body engagement portion configured to engage a portion of the hollow body of the shippable container, and an aperture configured to dispense contents from the hollow body of the shippable container. The dispenser can be configured to dispense contents from the hollow body of the shippable container when the shippable container is in an inverted position. The collar engagement portion can be configured to engage the collar and prevent rotation of the shippable container about the opening relative to the dispenser. In certain embodiments, the collar engagement portion and the closure engagement portion are comprised by a translatable member configured to receive a portion of the collar and a portion of the closure of the shippable container in a first position and in a second position. The closure sealing the opening of the shippable container includes a closure valve, where receipt of the portion of the collar and the portion of the closure in the first position maintains the closure valve in a closed position, and receipt of the portion of the collar and the portion of the closure in the second position maintains the closure valve in an opened position. In certain embodiments, the collar engagement portion is configured to engage the collar of the shippable container and the closure engagement portion is configured to engage the closure of the shippable container when the shippable container is in an upright position, where the collar engagement portion and the closure engagement portion are configured to pivot the shippable container to an inverted position.

Methods of using a shippable container can employ such dispensers, where the collar of the container is engaged with the collar engagement portion. The closure of the container is engaged with the closure engagement portion. A portion of the hollow body of the container is engaged with the body engagement portion. Contents can then be dispensed from the hollow body of the shippable container.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figures 1, 2, 3, 4:
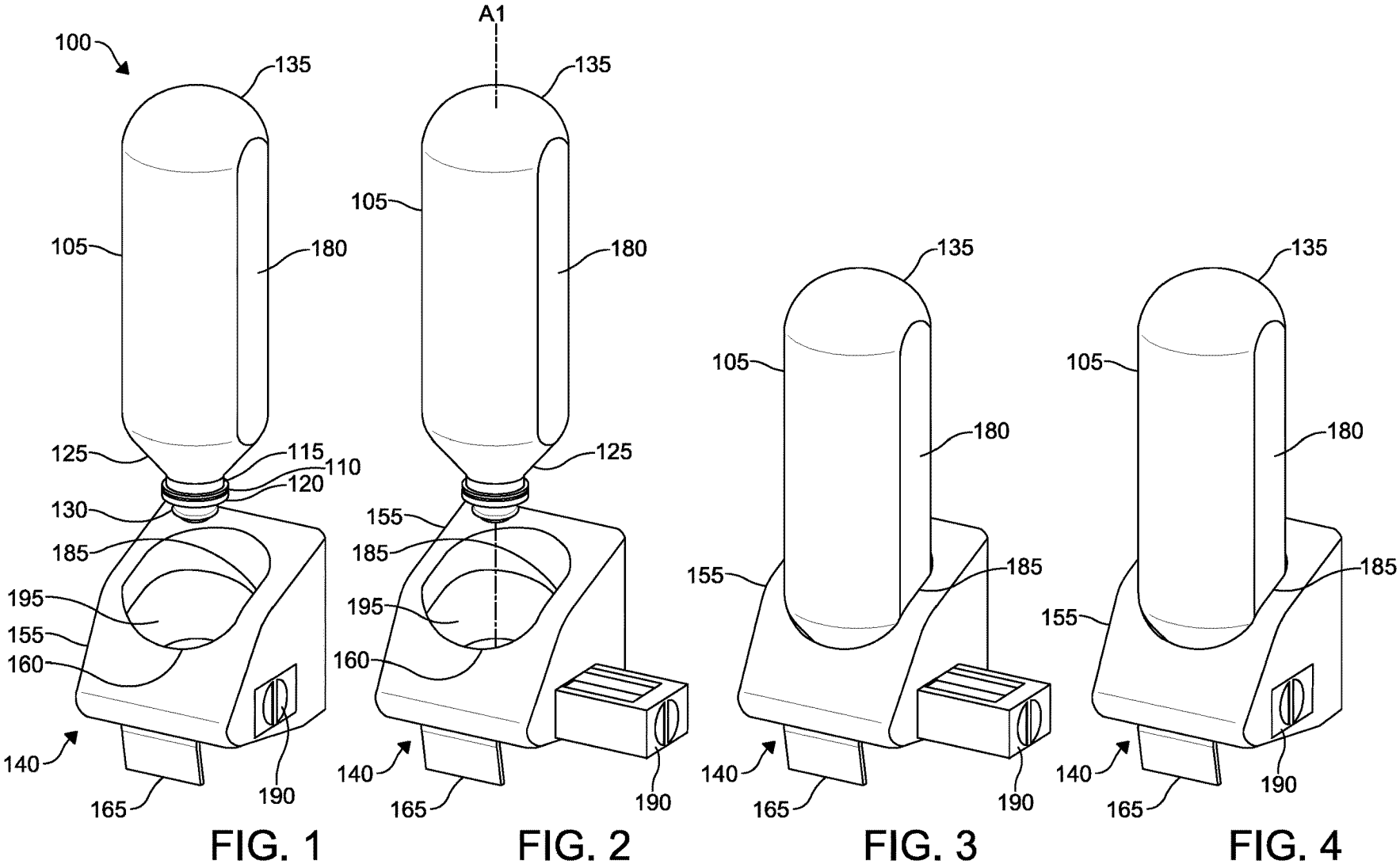
FIG. 1 is a perspective view of a first embodiment of a shippable container prior to being received and engaged by a first embodiment of a dispenser.
FIG. 2 is a perspective view of the first embodiment of the shippable container prior to being received and engaged by the first embodiment of the dispenser, where a translatable member of the dispenser is in an open position.
FIG. 3 is a perspective view of the first embodiment of the shippable container received and engaged by the first embodiment of the dispenser, where the translatable member of the dispenser is in the open position.
FIG. 4 is a perspective view of the first embodiment of the shippable container received and engaged by the first embodiment of the dispenser, where the translatable member of the dispenser is in a closed position.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology provides articles of manufacture, systems, and ways to use such articles and systems for dispensing contents of shippable containers, where such shippable containers include a hollow body, an opening, and a collar adjacent the opening. In particular, various dispensers are provided that can be coupled with various portions of shippable containers to optimize container durability during handling and/or dispensing of the contents of such containers. In this way, lightweight containers can be employed that require less material investment, that are less costly to manufacture and transport, and that minimize waste or recycling logistics. The present dispensers for shippable containers can achieve such special technical effects by using a collar engagement portion configured to engage the collar of the shippable container, a closure engagement portion configured to engage the closure of the shippable container, a body engagement portion configured to engage a portion of the hollow body of the shippable container, and an aperture configured to dispense contents from the hollow body of the shippable container.

Containers used in the present technology can include the following aspects. The shippable container can include a hollow body, an opening leading to the interior of the hollow body, and a collar adjacent the opening. The container can be formed of a single layer of material or can be formed using multiple layers of the same or different materials, where the entire container or only portions of the container may have multiple layers. Various materials can be used to form the container, including various polymers, glass, pottery, ceramic, and metals such as stainless steel and aluminum. However, containers made from polymer, such as PET, can provide certain manufacturing and cost advantages, including performance advantages with respect to strength and weight in comparison to other materials.

The container can include a base at an end of the container opposite the opening, where the base can define a portion of the hollow body and can be flat, rounded, or tapered in various embodiments. The hollow body can include a shoulder that is defined by a tapering of the hollow body towards the opening. The shoulder can end at a neck that can be of various lengths leading to the collar adjacent the opening. Certain containers can be described as having no neck portion or a minimized neck portion, where the shoulder effectively ends at the collar. It is also possible to have containers without any shoulder or neck, where the opening is sized like a cross-section of the hollow body, the container being jar-like in configuration. The container can also include a finish adjacent the collar and opening, where the finish can range from a smooth surface between the collar and a lip of the opening to where the finish can include various features such as one or more threads to receive a threaded closure and seal the opening. For example, the finish and/or the collar can be formed into a polymeric preform or parison that is subsequently blow-molded into a container. The collar can be a projection about the opening of the container, where the collar can be continuous or discontinuous about the opening. The collar can provide a width (e.g., diameter) relative to the opening and/or the finish that is larger than a portion of the container adjacent the collar on a side of the collar opposite the opening. The hollow body of the container can include a portion having a non-circular cross-section relative to the opening of the container. For example, the hollow body can have one or more flat sides or walls. A shippable container for use with the present technology can include the shippable container described in U.S. patent application Ser. No. 29/669,159 filed on Nov. 6, 2018.

Dispensers used in the present technology can include the following aspects. The dispenser can be configured to dispense contents from the hollow body of the shippable container when the shippable container is in an inverted position. For example, the shippable container is typically filled and/or stored in an upright position, where the opening of the container is above all or nearly all of the hollow body. The upright position can allow filling of the container with the assistance of gravity, for example, and allows contents of the container to remain therein until the closure is used to seal the opening of the container. An inverted position of the shippable container is understood to mean where the opening of the container is below all or nearly all of the hollow body. In the inverted position, for example, it is possible that gravity could pull the contents of the container out the opening if the closure is removed or compromised in some fashion.

The dispenser can include one or more features that prevent rotation of the shippable container once engaged by the dispenser. Preventing rotation can preserve a desired orientation of the shippable container with respect to the dispenser, which can be important for performance and/or aesthetic purposes, including maintenance of seals or sealing functions, engagement and wear issues, preserving orientation of indicia, instructions, or a content-viewing window in the container relative to the dispenser, among other purposes. Rotation can be prevented about the opening of the container relative to the dispenser, where rotation can include an extent of turning about an axis of the shippable container, where the axis passes through the opening of the container. For example, the axis can represent a longitudinal axis of the shippable container running through the opening, through the hollow body, and out a side of the the hollow body opposite the opening, such as the bottom of the container.

In various forms of the dispenser, the collar engagement portion, the closure engagement portion, and/or the body engagement portion can be configured to engage the collar and prevent rotation of the shippable container about the opening relative to the dispenser. For example, the collar engagement portion can be configured to engage a non-circular collar and prevent rotation of the shippable container, the closure engagement portion can be configured to engage a non-circular closure and prevent rotation of the shippable container, and/or the body engagement portion is configured to engage a portion of the hollow body having a non-circular cross-section and prevent rotation of the shippable container about the opening relative to the dispenser. Examples of non-circular features include features having non-circular cross-sections such as triangular, square, or other polygonal shapes. Various non-circular features further include asymmetric features including one or more projections extending from the collar, closure, and/or hollow body of the container, where the respective engagement portion of the dispenser includes a complementary feature to receive and secure at least a portion of the non-circular feature(s) and prevent rotation of the container about the opening. Where the collar provides a square-like cross-section relative to the opening, for example, the collar engagement portion can include a complementary recess so that the square-like collar cannot spin or rotate within the recess. This is unlike where a perfectly circular collar cross-section relative to the opening could spin or rotate within a complementary circular recess configured within the collar engagement portion relative to the opening.

Certain embodiments of the dispenser include where the collar engagement portion and the closure engagement portion are comprised by a translatable member. The translatable member is configured to receive a portion of the collar and a portion of the closure of the shippable container in a first position and in a second position. Here, the closure sealing the opening of the shippable container can include a closure valve such that receipt of the portion of the collar and the portion of the closure in the first position maintains the closure valve in a closed position and receipt of the portion of the collar and the portion of the closure in the second position maintains the closure valve in an opened position. The translatable member can be configured to move relative to the shippable container and the body engagement portion between the first position and the second position.

The dispenser can further include a dispensing control means configured to control dispensing of contents from the hollow body of the shippable container through the aperture. Some embodiments provide where the dispensing control means includes a push button operated valve. The push button valve can be a pump action valve that provides reversible opening and closing of the aperture that can be coupled with mechanical movement, fluid displacement, or gravity driven dispensing of contents of the shippable container. Other embodiments of the dispensing control means include valves operated by a paddle or lever.

The body engagement portion of the dispenser can include a tapered receiving portion to engage the portion of the hollow body of the shippable container. In this manner, the tapered receiving portion can be complementary to a shoulder of the hollow body defined by a tapering of the hollow body towards the opening of the shippable container. The extent with with the body engagement portion engages the hollow body of the shippable container can be tailored to physical properties of the shippable container, including height, weight, shape of the container, as well as whether the shippable container requires support to resist deformation.

In certain embodiments, both the collar engagement portion and the closure engagement portion can be configured to engage the closure of the shippable container when the shippable container is in an upright position. The collar engagement portion and the closure engagement portion can be further configured to pivot the shippable container from the upright position to an inverted position. Such dispensers can further include a cooperative collar engagement portion configured to engage the collar of the shippable container when the collar engagement portion is pivoted to where the shippable container is in the inverted position. Likewise, such dispensers can further include a cooperative closure engagement portion configured to engage the closure of the shippable container when the closure engagement portion is pivoted to where the shippable container is in the inverted position. The cooperative collar engagement portion and/or the cooperative closure engagement portion can operate with the collar engagement portion and/or the closure engagement portion to optimize retention and stability in securing the shippable container in the inverted position.

The dispenser can also have an opening means configured to open the closure of the shippable container. In particular instances, the opening means can be configured to open the closure of the shippable container when the the shippable container is in the inverted position. Embodiments include where the opening means is configured to pierce the closure of the shippable container. For example, the shippable container can be pivoted and secured in the inverted position and the closure sealing the opening can be contacted with the opening means, thereby piercing the closure and allowing contents of the container to be dispensed from the hollow body.

Shippable containers and dispensers as provided by the present technology can be used in various ways. Methods of using a shippable container can include the following steps. The collar of the shippable container can be engaged with the collar engagement portion, the closure of the shippable container can be engaged with the closure engagement portion, and the portion of the hollow body can be engaged with the body engagement portion. After which, it is then possible to dispense contents from the hollow body of the shippable container using the dispenser.

Various systems are provided by the present technology that include one or more various shippable containers in conjunction with one or more various dispensers. An example, of a system for dispensing contents from a shippable container includes a shippable container and a dispenser, where the shippable container has a hollow body, an opening, a collar adjacent the opening, and a closure sealing the opening and the dispenser has a collar engagement portion configured to engage the collar of the shippable container, a closure engagement portion configured to engage the closure of the shippable container, a body engagement portion configured to engage a portion of the hollow body of the shippable container, and an aperture configured to dispense contents from the hollow body of the shippable container. Various types of the shippable containers described herein can be matched with various types of the dispensers described herein.

EXAMPLES

Example embodiments of the present technology are provided with reference to the several figures enclosed herewith.

With reference to FIGS. 1-7, a first embodiment of a shippable container 100 is shown having a hollow body 105, an opening 110, and a collar 115 adjacent the opening 110, and a closure 120 sealing the opening 110. The container 100 has a shoulder 125 tapering toward the collar 115. The closure 120 includes a closure valve 130 that can provide selective access to the contents of the container 100. A base 135 of the container 100 is located at the bottom of the hollow body 105, generally opposite the opening 110 in the embodiment shown. As shown in FIGS. 1-4 and 6-7, the container 100 can be described as in an inverted position. The container 100 can be filled, transported, stored, and/or shipped in an upright position, where the opening 110 is above the base 135 with respect to gravity acting upon contents of the container 100.

A first embodiment of a dispenser 140 is shown having a collar engagement portion 145 configured to engage the collar 115 of the shippable container 100. A closure engagement portion 150 is configured to engage the closure 120 of the shippable container 100. A body engagement portion 155 is configured to engage a portion of the hollow body 105 of the shippable container 100. The body engagement portion 155 can include a tapered receiving portion 195 to engage the portion of the hollow body 105 of the container 100, where the tapered receiving portion 195 can be at least partially complementary to the shoulder 125 of the hollow body 105 defined by a tapering of the hollow body 105 towards the opening 110 of the container 100. An aperture 160 is configured in the dispenser 140 to dispense contents from the hollow body 105 of the shippable container 100.

As shown, the dispenser 140 can be configured to dispense contents from the hollow body 105 of the shippable container 100 when the container 100 is in the inverted position. The dispenser 140 can include a dispensing control means 165 that is configured to control dispensing of contents from the hollow body 105 of the shippable container 100 through the aperture 160. In the embodiment depicted, the dispensing control means 165 is configured as paddle operated valve, where pushing the paddle 170 allows passage through the aperture 160. The dispensing control means 165 can allow passage through the aperture based upon gravity flow or the dispensing control means 165 can be configured to actively pump contents therethrough when the paddle operated valve is pushed.

The dispenser can further include various anti-rotation features to secure the container 100 in a desired position. The collar engagement portion 145 can be configured to engage the collar 115 and prevent rotation of the shippable container 100 about the opening 110 relative to the dispenser 140. For example, with reference to FIGS. 2 and 5, when the container 100 is enclosed within the dispenser 140, the collar engagement portion 145 prevents the container 100 from rotating about axis A1 running through the opening 110 relative to the dispenser 140. In this way, a desired orientation or position of the container 100 can be maintained by preventing rotation of the container 100 within the dispenser 140. In the embodiment depicted, the collar engagement portion 145 is configured as a pair of opposing channels 170 that receive the collar 115 projecting about the opening 110 of the container 100. The collar engagement portion 145 can be configured to engage a non-circular collar 115 and prevent rotation of the shippable container 100 about the opening 110 relative to the dispenser 140. Likewise, the closure engagement portion 150 can be configured to engage a portion of the closure 120, including the closure valve 130 of the closure 120, and prevent rotation of the shippable container 100 about the opening 110 relative to the dispenser 140. In the embodiment depicted, the closure engagement portion 150 is configured as a pair of opposing stepped channels 175 that receive the closure valve 130 of the closure 120. The closure engagement portion 150 can be configured to engage a non-circular closure 110 and prevent rotation of the shippable container 100 about the opening 110, and about axis A1 which runs through the opening 110, relative to the dispenser 140. The body engagement portion 155 can also be configured to engage a portion of the hollow body 105 and prevent rotation of the shippable container 100 about the opening 110, and about axis A1 which runs through the opening 110, relative to the dispenser 140. In the embodiment depicted, the body engagement portion 155 is configured to engage a portion of the hollow body 105 having a non-circular cross-section and prevent rotation of the container 100 about the opening 110 relative to the dispenser 140. The portion of the hollow body 105 having a non-circular cross-section can include at least one flat side 180 on the hollow body 105. The flat side 180 can be at least partially received by and abut a complementary flat portion 185 of the body engagement portion 155 of the dispenser 140.

Figure 7:
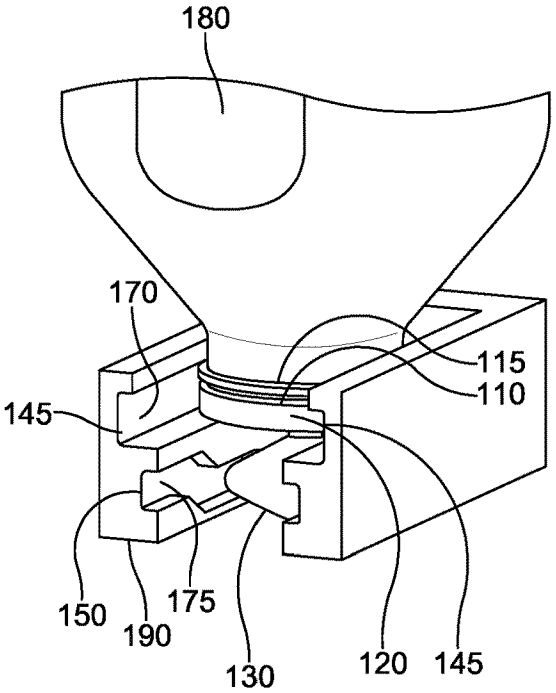
FIG. 7 is a perspective view of the translatable member of the first embodiment of the dispenser receiving the portion of the collar and the portion of the closure of the first embodiment of the shippable container in a second position.
Figure 6:
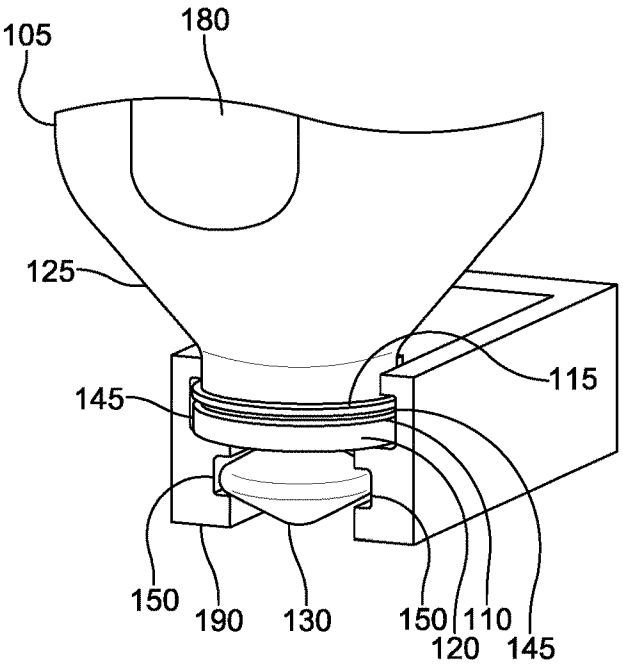
FIG. 6 is a perspective view of the translatable member of the first embodiment of the dispenser receiving a portion of a collar and a portion of a closure of the first embodiment of the shippable container in a first position.
Figure 5:
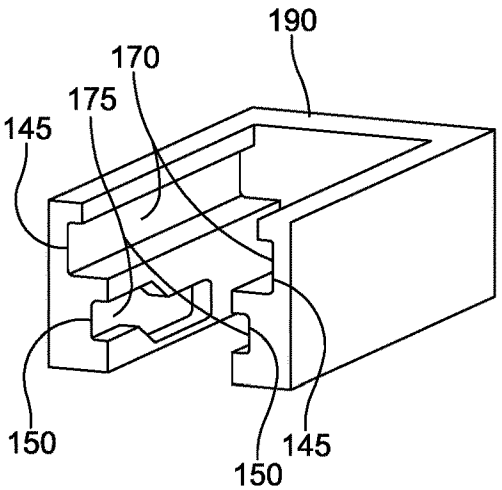
FIG. 5 is a perspective view of the translatable member of the first embodiment of the dispenser.

As provided in the first embodiment of the dispenser shown in FIGS. 1-7, the collar engagement portion 145 and the closure engagement portion 150 are comprised by a translatable member 190 configured to move between a first position and a second position relative to the container 100. As shown in FIGS. 3 and 6, the translatable member 190 can receive a portion of the collar 115 and a portion of the closure 120 of the shippable container 100 in a first position. As shown in FIGS. 4 and 7, the translatable member 190 can receive a portion of the collar 115 and a portion of the closure 120 of the shippable container 100 in a second position. The closure 120, including the closure valve 130, seals the opening 110 of the shippable container 110, where receipt of the portion of the collar 115 and the portion of the closure 120 in the first position maintains the closure valve 130 in a closed position, and receipt of the portion of the collar 115 and the portion of the closure 120 in the second position maintains the closure valve 130 in an opened position. As best shown in FIG. 5, a distance between the collar engagement portion 145, configured as a pair of opposing channels 170, and the closure engagement portion 150, configured as a pair of opposing stepped channels 175, increases between the first position and the second position. In this way, the closure valve 130 of the closure 120 can be pulled and/or extended away from a remainder of the closure 120 thereby opening the valve in the second position. The translatable member 190 is accordingly configured to move relative to the shippable container 100 and the body engagement portion 155 between the first position and the second position. In this way, the closure valve 130 can be opened and closed with the container 100 in the inverted position to prevent leaking of contents when an substantially empty or partially empty container 100 is removed or replaced from the dispenser 140.

Figures 8, 9, 10:
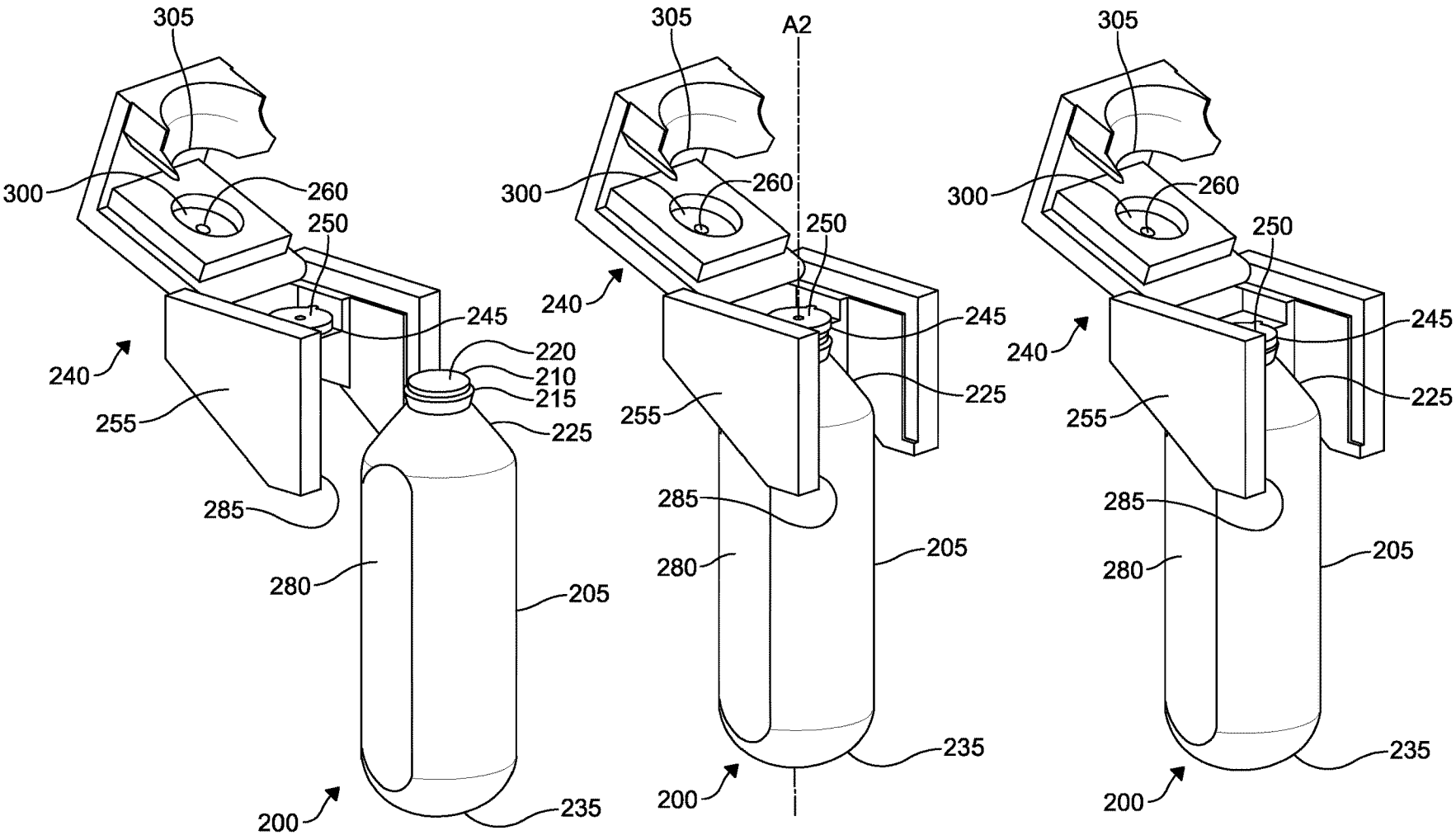
FIG. 8 is a perspective view of a second embodiment of a shippable container prior to being received and engaged by a second embodiment of a dispenser.
FIG. 9 is a perspective view of the second embodiment of the shippable container received and engaged by the second embodiment of the dispenser, where an opening means of the dispenser is positioned relative to the closure sealing the opening of the container.
FIG. 10 is a perspective view of the second embodiment of the shippable container received and engaged by the second embodiment of the dispenser, where the opening means of the dispenser has operated on the closure to open the closure of the container.
Figure 12:
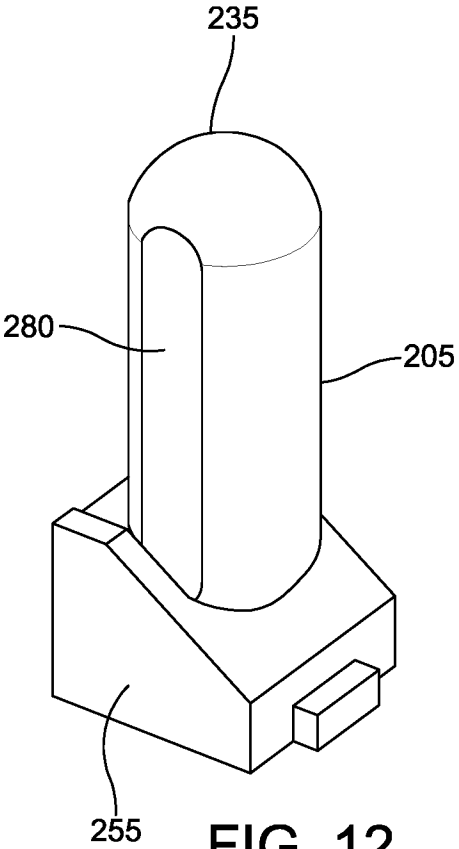
FIG. 12 is a perspective view of the second embodiment of the shippable container received and engaged by the second embodiment of the dispenser, where the shippable is pivoted to an inverted position.
Figure 11:
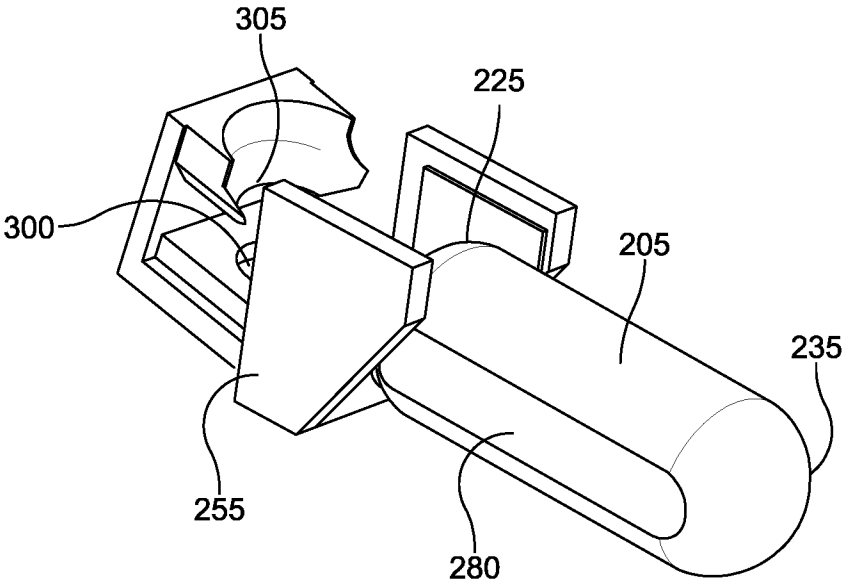
FIG. 11 is a perspective view of the second embodiment of the shippable container received and engaged by the second embodiment of the dispenser, where the shippable is in an intermediate pivoted position.
Figure 14:
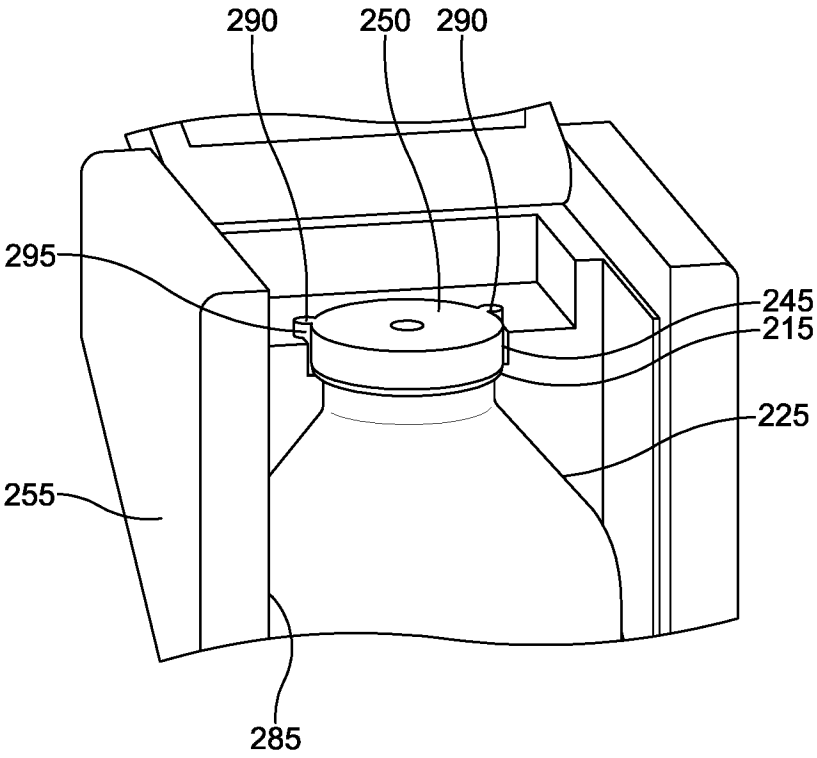
FIG. 14 is a close-up perspective view of a portion of FIG. 10.
Figure 13:
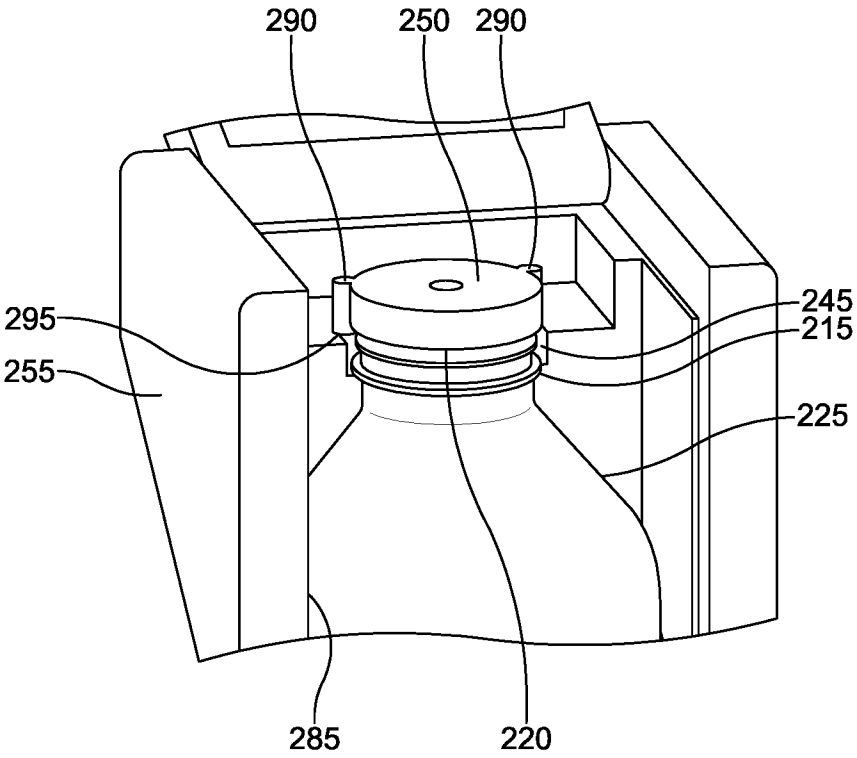
FIG. 13 is a close-up perspective view of a portion of FIG. 9.

With reference to FIGS. 8-14, a second embodiment of a shippable container 200 is shown having a hollow body 205, an opening 210, and a collar 215 adjacent the opening 210, and a closure 220 sealing the opening 210. The container 200 has a shoulder 225 tapering toward the collar 215. The closure 220 can be a plastic or foil seal to effectively seal the contents of the container 200 therein. The closure 220 (e.g., the foil or plastic seal) located on or within the opening 210 can also have one or more perforations or other directed or guided tear-lines thereon that facilitate and/or guide opening of the closure 220 seal. A base 235 of the container 200 is located at the bottom of the hollow body 205, generally opposite the opening 210 in the embodiment shown. As shown in FIGS. 8-10, the container 200 can be described as in an upright position, where FIG. 11 shows an intermediate pivoted position, and FIG. 12 shows the container 200 pivoted to an inverted position. The container 200 can be filled, transported, stored, and/or shipped in an upright position, where the opening 210 is above the base 235 with respect to gravity acting upon contents of the container 200.

A second embodiment of a dispenser 240 is shown having a collar engagement portion 245 configured to engage the collar 215 of the shippable container 200. A closure engagement portion 250 is configured to engage the closure 220 of the shippable container 200. A body engagement portion 255 is configured to engage a portion of the hollow body 205 of the shippable container 200. The body engagement portion 255 can be configured to engage a portion of the hollow body 205 and prevent rotation of the shippable container 200 about the opening 210, and about axis A2 which runs through the opening 210, relative to the dispenser 240. In the embodiment depicted, the body engagement portion 255 can be configured to engage a portion of the hollow body 205 having a non-circular cross-section and prevent rotation of the container 200 about the opening 210 relative to the dispenser 240. The portion of the hollow body 205 having a non-circular cross-section can include at least one flat side 280 on the hollow body 205. The flat side 280 can be at least partially received by and abut a complementary flat portion 285 of the body engagement portion 255 of the dispenser 240. An aperture 260 is configured in the dispenser 240 to dispense contents from the hollow body 205 of the shippable container 200.

The second embodiment of the dispenser 240 further includes the following aspects. The closure engagement portion 250 includes at least one protrusion 290 that is received within a recess 295 adjacent the closure engagement portion 250 of the dispenser 240. Placement of the protrusion 290 within the recess 295 prevents rotation of the closure engagement portion 250 relative to a remainder of the dispenser 240 and thereby can prevent rotation of the container 200 about the opening 210 relative to the dispenser 240 when the closure engagement portion 250 is engaged with the closure 220 of the container 200. As can be seen in FIGS. 9-10 and 13-14, the collar engagement portion 245 is configured to engage the collar 215 of the container 200 and the closure engagement portion 250 is configured to engage the closure 220 of the container 200 when the container 200 is in an upright position, where the collar engagement portion 245 and the closure engagement portion 250 are configured to pivot the container 200 to the inverted position shown in FIG. 12. Engagement of the closure engagement portion 250 with the closure 220 is shown by the change between FIG. 13 and FIG. 14, as the closure engagement portion 250 is pushed down upon the closure 220. It should be noted, however, that engagement of the closure engagement portion 250 with the closure 220 can occur partially or entirely after the container 200 is pivoted to the inverted position shown in FIG. 12. That is, the weight of the container 200 can result in or contribute to the closure 220 being contacted and engaged with the closure engagement portion 250 of the dispenser 240.

The second embodiment of the dispenser 240 is also shown having a cooperative collar engagement portion 305 configured to engage the collar 215 of the container 200 when the collar engagement portion 245 is pivoted to where the container 200 is in the inverted position, as shown in FIG. 12. The dispenser 240 also has a cooperative closure engagement portion 300 configured to engage the closure engagement portion 250 when the closure engagement portion 250 is pivoted to where the container 200 is in the inverted position, as shown in FIG. 12. The dispenser can include an opening means configured to open the closure 220 of the container 200, where the opening means can also be configured to open the closure 220 of the container 200 when the container 200 is in the inverted position. For example, the opening means can be a pin or projection that is part of the closure engagement portion 250 that pierces or compromises the closure 220 of the container 200 when engaged therewith. Other opening means can include a pin or projection feature associated with the cooperative closure engagement portion 300 and/or aperture 260 that pierces or compromises the closure 220 of the container 200 when the container 200 is in the inverted position. The closure 220 (e.g., the foil or plastic seal) located on or within the opening 210 can also have one or more perforations or other directed or guided tear-lines thereon that facilitate and/or guide opening of the closure 220 seal by the opening means, such as the pin or projection feature. The weight of the container 200 and/or a push down on the container 200 in the inverted position can be used to effectuate the opening means.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A dispenser for a shippable container, the shippable container including a hollow body, an opening, a collar adjacent the opening, and a closure sealing the opening, the dispenser comprising:

a collar engagement portion configured to engage the collar of the shippable container;

a closure engagement portion configured to engage the closure of the shippable container;

a body engagement portion configured to engage a portion of the hollow body of the shippable container; and an aperture configured to dispense contents from the hollow body of the shippable container;

wherein the collar engagement portion and the closure engagement portion are comprised by a translatable member, the translatable member configured to receive a portion of the collar and a portion of the closure of the shippable container in a first position and in a second position, the closure sealing the opening of the shippable container including a closure valve, where receipt of the portion of the collar and the portion of the closure in the first position maintains the closure valve in a closed position, and receipt of the portion of the collar and the portion of the closure in the second position maintains the closure valve in an opened position.

2. The dispenser of claim 1, wherein the dispenser is configured to dispense contents from the hollow body of the shippable container when the shippable container is in an inverted position.

3. The dispenser of claim 1, wherein the collar engagement portion is configured to engage the collar and prevent rotation of the shippable container about the opening relative to the dispenser.

4. The dispenser of claim 1, wherein the closure engagement portion is configured to engage the closure and prevent rotation of the shippable container about the opening relative to the dispenser.

5. The dispenser of claim 1, wherein the closure engagement portion includes a recess configured to receive a protrusion from the closure of the shippable container and prevent rotation of the shippable container about the opening relative to the dispenser.

6. The dispenser of claim 1, wherein the body engagement portion is configured to engage a portion of the hollow body and prevent rotation of the shippable container about the opening relative to the dispenser.

7. The dispenser of claim 1, wherein the translatable member is configured to move relative to the shippable container and the body engagement portion between the first position and the second position.

8. The dispenser of claim 1, further comprising a dispensing control means configured to control dispensing of contents from the hollow body of the shippable container through the aperture.

9. The dispenser of claim 8, wherein the dispensing control means includes a push button operated valve.

10. The dispenser of claim 1, wherein the body engagement portion includes a tapered receiving portion to engage the portion of the hollow body of the shippable container, the tapered receiving portion complementary to a shoulder of the hollow body defined by a tapering of the hollow body towards the opening of the shippable container.

11. A method of using a shippable container, the shippable container including a hollow body, an opening, a collar adjacent the opening, and a closure sealing the opening, the method comprising:

providing a dispenser including:

a collar engagement portion configured to engage the collar of the shippable container;

a closure engagement portion configured to engage the closure of the shippable container;

a body engagement portion configured to engage a portion of the hollow body of the shippable container; and an aperture configured to dispense contents from the hollow body of the shippable container;

wherein the collar engagement portion and the closure engagement portion are comprised by a translatable member, the translatable member configured to receive a portion of the collar and a portion of the closure of the shippable container in a first position and in a second position, the closure sealing the opening of the shippable container including a closure valve, where receipt of the portion of the collar and the portion of the closure in the first position maintains the closure valve in a closed position, and receipt of the portion of the collar and the portion of the closure in the second position maintains the closure valve in an opened position; and engaging the collar with the collar engagement portion;

engaging the closure with the closure engagement portion; and engaging the portion of the hollow body with the body engagement portion.

12. The method of claim 11, further comprising dispensing contents from the hollow body of the shippable container.

13. A system for dispensing contents from a shippable container comprising:

a shippable container including a hollow body, an opening, a collar adjacent the opening, and a closure sealing the opening; and a dispenser including a collar engagement portion configured to engage the collar of the shippable container, a closure engagement portion configured to engage the closure of the shippable container, a body engagement portion configured to engage a portion of the hollow body of the shippable container, and an aperture configured to dispense contents from the hollow body of the shippable container, wherein the collar engagement portion and the closure engagement portion are comprised by a translatable member, the translatable member configured to receive a portion of the collar and a portion of the closure of the shippable container in a first position and in a second position, the closure sealing the opening of the shippable container including a closure valve, where receipt of the portion of the collar and the portion of the closure in the first position maintains the closure valve in a closed position, and receipt of the portion of the collar and the portion of the closure in the second position maintains the closure valve in an opened position.

14. The method of claim 11, wherein the translatable member of the dispenser is configured to move relative to the shippable container and the body engagement portion between the first position and the second position.

15. The method of claim 11, wherein the dispenser further comprises a dispensing control means configured to control dispensing of contents from the hollow body of the shippable container through the aperture.

16. The method of claim 15, wherein the dispensing control means of the dispenser includes a push button operated valve.

17. The system of claim 13, wherein the translatable member of the dispenser is configured to move relative to the shippable container and the body engagement portion between the first position and the second position.

18. The system of claim 13, wherein the dispenser further comprises a dispensing control means configured to control dispensing of contents from the hollow body of the shippable container through the aperture.

19. The system of claim 18, wherein the dispensing control means of the dispenser includes a push button operated valve.

20. The system of claim 13, wherein the body engagement portion of the dispenser includes a tapered receiving portion to engage the portion of the hollow body of the shippable container, the tapered receiving portion complementary to a shoulder of the hollow body defined by a tapering of the hollow body towards the opening of the shippable container.

* * * * *